United States Patent [19]

Nakajima

[11] Patent Number: 5,000,198

[45] Date of Patent: Mar. 19, 1991

[54] AGENT FOR REMOVING NOXIOUS TOBACCO COMPONENTS

[76] Inventor: Mituo Nakajima, 10-1 Yatomati 1-chome, Tanashi-shi, Tokyo, Japan

[21] Appl. No.: 365,325

[22] Filed: Jun. 13, 1989

[51] Int. Cl.[5] ..... A24D 1/02

[52] U.S. Cl. ..... 131/331; 131/334; 131/343

[58] Field of Search ..... 131/331, 343, 334

*Primary Examiner*—V. Millin

*Attorney, Agent, or Firm*—Pollock, VandeSande & Priddy

[57] ABSTRACT

An agent for removing noxious tobacco components is disclosed, which is attached to or sprinkled over sliced tobacco leaves when producing a cigarette. The agent is produced by mixing menthol in the form of crystalline menthol microcapsules, disodium glycrrhizinate, confree particles, perleloxyantoxyn, stearic acid B in the form of particles, maltol, glove-aniline, lecithin, ammonium benzoate, vanillin, calcium carbonate, corn starch and beans in the form of particles.

2 Claims, 3 Drawing Sheets

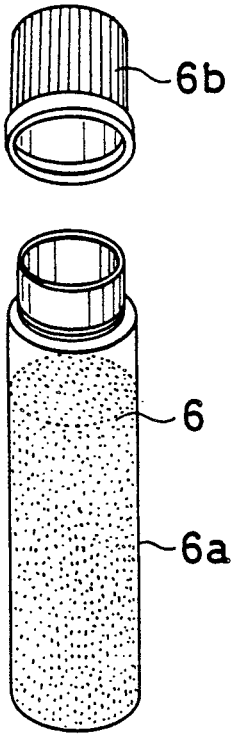
FIG. 1
FIG. 2
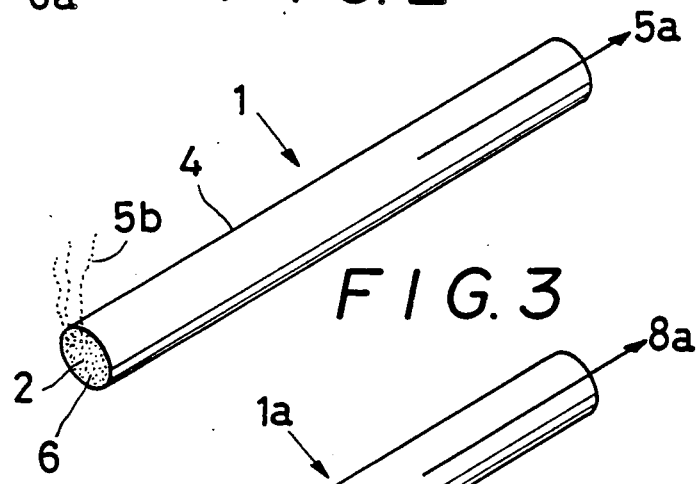
FIG. 3
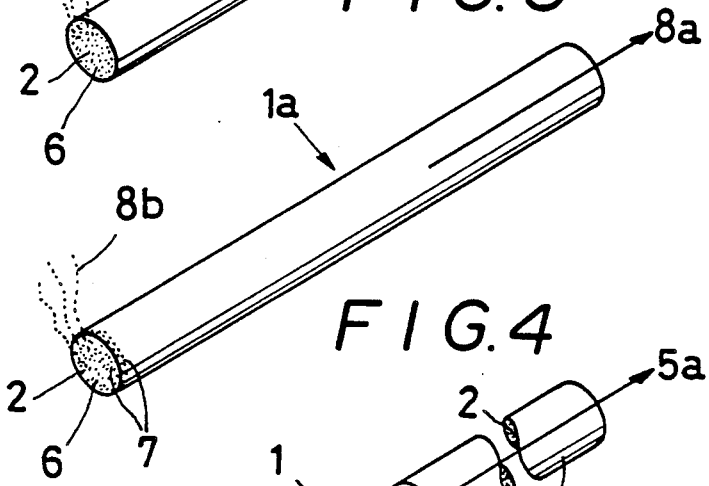
FIG. 4
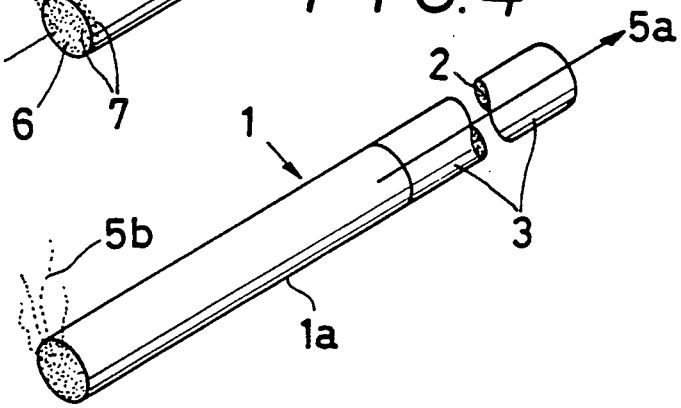

AGENT FOR REMOVING NOXIOUS TOBACCO COMPONENTS

BACKGROUND OF THE INVENTION

1. Field of the Invention

This invention relates to an agent for removing noxious tobacco components and, more particularly, to a noxious tobacco component removal agent, which is used in a form attached to or sprinkled over sliced tobacco leaves when producing cigarettes and can provide a noxious tobacco component removal action to remove adverse effects on the smoker and nearby people at the time of smoking.

2. Description of the Prior Art

Men met tobacco very long ago. Tobacco has been smoked since the time when Columbus found the American Continent, and now there is a trend for increase rather than decrease of smokers.

Tobacco is thought to induce pneumocancer and various other cancer diseases. When someone smokes tobacco, carcinogenic substances, nitrosoamine, carbon monoxide, nicotine, etc. in tar contained in tobacco smoke are inhaled by the mouth of the smoker, and absorbed in the body through mouth membrane. This is thought to be a cause of cancer affecting nearby people as well as the smoker.

Further, doctors recommend hypertensives not to smoke tobacco because tobacco makes the disease worse.

To prevent adverse effects of tobacco a commercially available cigarette 1 as shown in FIG. 4 is provided. In this cigarette, a filter 3 consisting of a filtering material 2 capable of filtering noxious substances and wrapped in paper is provided at one end 1*a* of the cigarette 1.

In this case, however, although the filter 3 can filter out smoke 5*a* entering the mouth of the smoker to provide a certain effect of filtering, other smoke 5*b* is dispersed to have adverse effects on nearby people as well as the smoker.

SUMMARY OF THE INVENTION

An object of the invention is to overcome the above deficiency.

To attain this object of the invention, there is provided an agent for removing noxious tobacco components, which agent is produced by mixing menthol in the form of crystalline menthol microcapsules, disodium glycrrhizinate, confree particles, perleloxyantoxyn, stearic acid B in the form of particles, maltol, (available as BERTHOL) gloveaniline, lecithin, ammoniun benzoate, vanillin, calcium carbonate, corn starch and beans (preferably soy beans) in the form of particles.

According to the invention, there is also provided an agent for removing noxious tobacco components, which is in the form of either particles, granules or styluses.

The agent for removing noxious tobacco components according to the invention has an action as a non-ionic surface active agent. Therefore, when a cigarette is lighted, tar, produced as a result of combustion of tobacco, is absorbed by the agent.

This has an effect of slowing down the distillation of tar. In consequence, the decomposition of benzopyrene and N-nitrosodimethyl amine is reduced to reduce the amount of noxious tobacco components withdrawn from the mouth and acting as carcinogenic agent.

The noxious tobacco component removal agent according to the invention can also reduce nicotine.

Nicotine may be classified into two types, i.e., volatile and non-volatile types. The agent according to the invention can convert volatile nicotine to be non-volatile and innoxious. Thus, the amount of nicotine withdrawn together with smoke from the mouth can be reduced.

Recently, it was found and reported that the resin part of tobacco leaves contains a cembranoid component or CBI (cembratriendiol) in an amount of about 1 % by weight and 50 ppm per cigarette (which is about 1 g in weight). It is confirmed that CBI has an effect of removing villous tumor on the mouth.

However, it is reported that CBI is decomposed more greatly and more quickly by active oxygen generated from tobacco being smoked so that its anti-tumor effect can not be expected.

The inventor tried to incorporate ammonious benzoate into the noxious tobacco component removal agent so that CBI may be withdrawn in a stable form from the smoker's mouth in smoking tobacco.

It is found that the oxidizing effect of active oxygen to decompose CBI is suppressed. This means that the agent for removing noxious tobacco components according to the invention has an effect of suppressing carcinogenic action.

BRIEF DESCRIPTION OF THE DRAWINGS

FIG. 1 is a perspective view showing a case accommodating the noxious tobacco component removal agent according to the invention;

FIGS. 2 and 3 are each a view showing a cigarette using the noxious tobacco component removal agent according to the invention;

FIG. 4 is a perspective view, partly broken away, showing a cigarette without any noxious tobacco component remover.

DESCRIPTION OF THE PREFERRED MODE OF THE INVENTION

Figure 5:
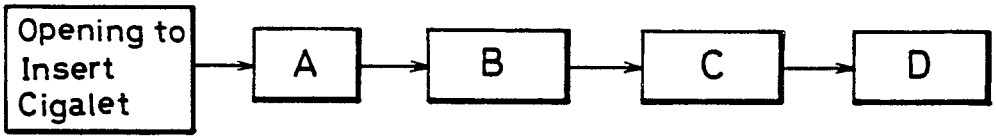
FIGS. 5 to 10 are views showing smoke extraction methods.

Now, the invention will be described with respect to the detailed structure thereof with reference to the drawings.

FIG. 1 shows a plastic case 6*a* accommodating an agent 6 for removing noxious tobacco components. The case 6*a* is sealed with a lid 6*b* to retain the agent 6 inside.

FIG. 2 is a view for explaining the method of use of the noxious tobacco component removal agent 6. The agent 6 is added in the form of particles to sliced tobacco leaves in an end portion of a cigarette 10 to 30 mg in length (which is by no means limitative) before the sliced tobacco leaves are wrapped with cigarette paper 4. When this cigarette is smoked, noxious tobacco components contained in smoke, inclusive of smoke 5*a* that enters the smoker's mouth and other smoke 5*b*, are removed by the agent 6.

FIG. 3 illustrates the use of the noxious tobacco component removal agent. When smoking, the end of the cigarette 7, is inserted into the plastic case 6*a* accommodating the agent 6 pressing the particles thereof against 10 to 30 mg of the end 7 of the cigarette 1. The amount of particles of the agent pressed in this manner is by no means limitative.

When the cigarette 1 is lighted with the noxious tobacco component removal agent 6 at its end, noxious tobacco components immediately sublime into a gas, which passes through interstices of the sliced tobacco leaves in the cigarette. At this time, the cigarette is lighted. The noxious, tobacco component removal agent thus converts volatile nicotine into a non-volatile state and also absorbs penspyrene and nitroamide, thus making the$e components more difficult to be decomposed.

Further, merely attaching the noxious tobacco component removal agent, provides for sublimation. Only the amount of agent that is attached provides for sufficient sublimation.

The noxious tobacco component removal agent 6 according to the invention is obtained by mixing menthol in the form of crystalline microcapsules, disodium glycrrhizinate, confree particles, perleloxyantoxyn, stearic acid B in the form of particles, meltol, (available as BERTHOL) gloveaniline, lecthin, ammoniun benzoate, vanillin, calcium carbonate, corn starch and beans (preferably soy beans) in the form of particles in adequate proportions.

The proportions are considerably variable, but the best proportions in per cent are as follows.

| Name | Proportion (%) |
|---|---|
| Menthol | 0.5 |
| Ascorbic acid | 30.0 |
| Disodium glycrrhizinate | 10.0 |
| Confree | 34.0 |
| Perleloxyantioxyn | 0.3 |
| Stearic acid B | 15.0 |
| Maltol | 2.0 |
| Gloveanilin | 0.5 |
| Lecithin | 7.0 |
| Ammonium benzoate | 0.2 |
| Corn starch | 1.0 |
| Beans | 1.0 |
| Vanillin | 0.5 |
| Total | 100.0 |

Further, if necessary, castor oil, jasmin and various other tobacco flavors may be incorporated.

The effect of the noxious tobacco component removal agent having the above composition was determined by the following method of smoke extraction and method of quantitative analysis contained in smoke.

Smoke produced in smoking includes main smoke 5*a*, 8*a*, which enters the smoker's mouth and other smoke 5*b*, 8*b*, which does not enter the mouths of the smoker and nearby people and hence has no adverse effect on the nearby people.

(A) Main smoke was extracted by an artificially manufactured smoke extractor.

(1) Nicotine and cembratriendiol were extracted in a method as shown in FIG. 5.

Designated at A and B are capturing bins, C a flow meter, and D a suction pump.

Figure 6:
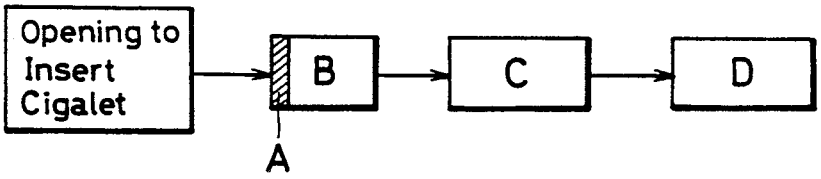

(2) Benzopyrene and N-nitrosodimethyl amine were extracted in a method as shown in FIG. 6.

Designated at A is a capturing filter, B a holder, C a flow meter, and D a suction pump.

Figure 7:
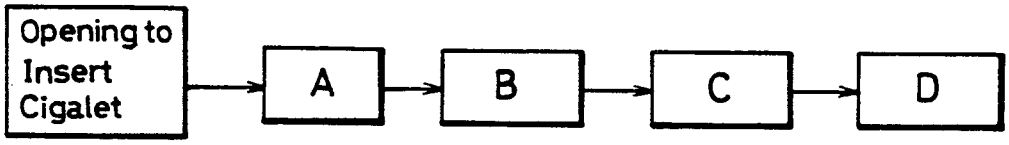

(3) Carbon monoxide was extracted in a manner as shown in FIG. 7.

Designated at A and B are vinyl bags, C a flow meter, and D a sUction pump.

A cigarette weighing about 1 g was used. The combustion time in smoking one cigarette was set sUch that it was completely combusted in about 6 minutes.

Figure 8:
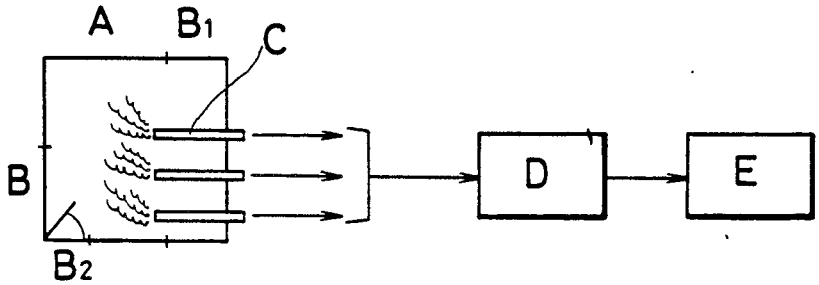

(B) Other smoke in smoking was extracted using an artificially produced machine as shown in FIG. 8.

Designated at A is a $Zm_2^3$ closed chamber of another smoke extraction box, B an extracted sample inlet of the chamber, B1 an air inlet of the chamber, B2 an operator's inlet/exit, C a cigarette, D a flow meter, and E a suction pump.

Simultaneously with lighting the cigarette, the suction pump E was started for artificial smoking of the cigarette.

The speed of smoking was set sUch that one cigarette weighing about 1 g was perfectly combusted in 6 minutes. In one smoking cycle, six cigarettes weighing about 1 g were combusted.

Other smoke, if necessary, was extracted by a sample inlet of a sample capturing device.

Figure 9:
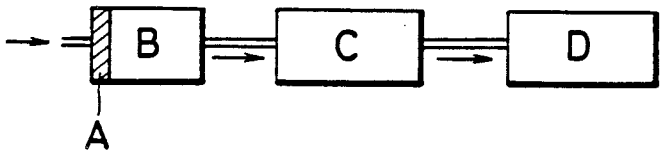

(1) When capturing N-nitrosodimethyl amine and benzopyrene, a method as shown in FIG. 9 was adopted.

Designated at A is a capturing filter, B a holder, C a sUction pump, and D a flow meter.

(2) Carbon monoxide was captured by a vinyl bag method.

Figure 10:
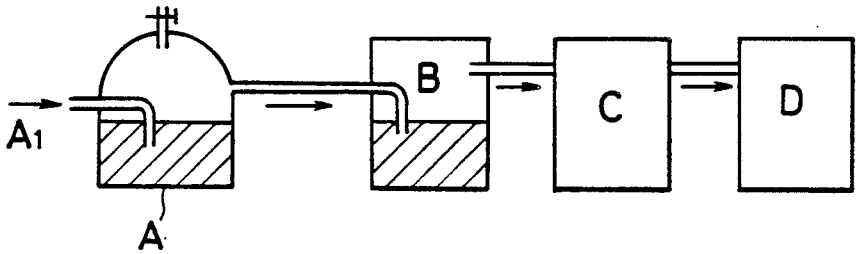

(3) Nicotine and cembratriendiol were extracted in a method as shown in FIG. 10.

Designated at A and B are capturing bins, A' a smoke inlet, C an extraction pump, and D a flow meter.

Smoke extracted by the above smoke extraction device was measUred by the following methods to test the effect of the noxious tobacco component removal agent.

| Method of smoke analysis (same smoke and other smoke) | |
|---|---|
| Name of compound | Method of measurement |
| Nicotine | Optical rotation degree measurement process $(d)_D$-169 |
| Carbon monoxide | Spectral inflared analysis process (optical path length cell) carbon monoxide standard gas comparison with JI5K0001 and JI5K0002 |
| Benzopyrene | Bio-layer semi-dimensional thin-layer chromotographic spectral fluorescence process (BASELINE process) |
| Nitrosoamine | Water quality (liquid extraction)-color chromotography (GC-MS)<br>Bottom quality (liquid extraction)-color chromotography (GC-MS) |
| Cembratriendiol | Thin-layer chromatography |

The following are results of experiments of use of noxious tobacco component removal agent of the composition noted above.

| Name of compound | Non-treated (%) | Treated (%) |
|---|---|---|
| Main smoke (5a, 8a) | | |
| Nicotine | 100 | 9.5–10 |
| Benzopyrene | 100 | 10–20 |
| Nitrosoamine | 100 | 10–20 |
| CBT | 10 | 98.5 |
| Bismoke (5b, 8b) | | |
| Nicotine | 100 | 9.5–10 |
| Benzopyrene | 100 | 10–20 |

-continued

| Name of compound | Non-treated (%) | Treated (%) |
|---|---|---|
| Nitrosoamine | 100 | 10–20 |
| CBT | 10 | 98.5 |

The values in the colUmn "Non-treated" represent he amounts of compounds entering the mouth when smoking without use of any noxious tobacco component removal agent, and the values in the column "Treated" represent the amounts of components entering the mouth when smoking with the noxious tobacco component removal agent.

In smoke 5*a*, 8*a* (main smoke) entering the moUth of the smoker who smokes a cigarette with the end thereof provided with the noxious tobacco component removal agent, nicotine is reduced from 100 % to 10 %, benzopyrene and N-nitrosodimethyl amine are reduced from 100 % to 10 %, and CTB is 10 % in case of nontreatment and 98.5 % in case of treatment. This result indicates that tobacco can be smoked safely by using the noxious tobacco component removal agent.

In bi-smoke 5*a*, 8*b*, which does not enter the mouth of the smoker and nearby people when tobacco is smoked, i.e., which has no adverse effects on the smoker and nearby people, like main smoke 5*a*, 8*a*, nicotine is reduced from 100 % to 10 %, benzopyrene and N-nitrosodimethyl amine are reduced from 100 % to 10 %, and CTB is 10 % in case of non-treatment and 98.5 % in case of treatment. This means that tobacco can be smoked without adversely affecting nearby people at all.

The action of removing noxious tobacco components in smoke is provided as soon as tobacco smoke is generated. Therefore, in smoking cigarette 1 which is produced by sprinkling the noxious tobacco component removal agent, or cigarette 1*b* with the noxious tobacco component removal agent pressed thereagainst, the noxious components in all smoke, including smoke 8*a* entering the smoker's mouth after passing through the flue 9 and other smoke 8*b*, can be removed.

Thus, the noxious tobacco component removal agent can be effective for nearby people as well as the smoker.

The noxious tobacco component removal agent may be provided in the form of small particles, granules, styluses and capsules.

This noxious tobacco component removal agent absorbs water content in air when the product is in stock a long time. As a result, its effective components undergo chemical reaction with one another in the form of either particles, granules, styluses and capsules, thus solidifying to result in its reduction.

However, by adding an adequate quantity of calcium carbonate, it is possible to prevent absorption of Water content of air. Thus, by so doing, the noxious tobacco component removal agent can be preserved for a long time without deterioration of its quality irrespective of whether it is in the form of particles, granules, styluses or capsules, so that it can be economically and readily stored.

When attaching the noxious tobacco component removal agent at the end of a cigarette, it is liable to be detached at the time of lighting the cigarette. In this case, the desired amount of agent attached to the cigarette can not be provided.

By adding corn starch and beans in particles, it is possible to have a desired amount of noxioUs tobacco component removal agent remaining attached to any cigarette product, so that the intended noxious tobacco component removal effect can be attained perfectly. In the form of granules of the noxious tobacco component removal agent, it is possible to sprinkle a desired effective amount of noxious tobacco component removal agent when producing a cigarette.

As has been described in the foregoing, with the noxious tobacco removal agent provided at the end of a cigarette when smoking according to the invention, noxious tobacco components can be removed as soon as tobacco smoke is generated, so that the cigarette can be smoked safely.

Since the noxious tobacco component removal agent provided at the cigarette end provides an action of non-ionic surface active agent when the cigarette is smoked, it permits absorption, tar produced as a result of combustion of tobacco and alleviates the reduction of distillation of tar. Thus, benzopyrene and N-nitorsodimethyl amine become less easily decomposed, thus reducing the amount of carcinogenic substance exhaled from the mouth.

Further, since it converts volatile nicotine to be non-volatile, the amount of nicotine entering the mouth can be reduced.

Furthermore, since ammonium benzoate is contained, cembratriendiol (CBI) contained in tobacco and serving an anti-tumor substance is protected by ammonium benzoate, so that it is possible to prevent reduction of the anti-carcinogenic effect of CBI Further, since the noxious tobacco component removal agent contains calcium carbonate, it does not absorb water content of air, so that it never undergoes any chemical reaction. Thus, it can a stable effect and can be preserved for a long time irrespective of whether it is in the form of particles, granules, styluses or capsules.

Furthermore, since it contains corn starch or beans in particles, it can be attached and held attached in an effective amount sufficiently to a cigarette end without possibility of detachment. Thus, its purpose can be attained sufficiently. Further, it may be sprinkled in the form of particles and granules to sliced tobacco leaves in producing a cigarette.

What is claimed is:

1. An agent for removing noxious tobacco components, said agent being produced by mixing menthol in the form of crystalline menthol microcapsules, ascorbic glythimin, confree particles, perleloxyantoxyn, stearic acid B in the form of particles, maltol, gloveaniline, lecithin, ammonium benzoate, vanillin, calcium carbonate, corn starch and soy beans in the form of particles.

2. The agent according to claim 1, which is in the form of either particles, granules or styluses.

* * * * *

UNITED STATES PATENT AND TRADEMARK OFFICE

CERTIFICATE OF CORRECTION

PATENT NO. : 5,000,198

DATED : March 19, 1991

INVENTOR(S) : Mituo Nakajima

It is certified that error appears in the above-identified patent and that said Letters Patent is hereby corrected as shown below:

Column 3, line 9, change "the$e" to --these--.

Column 3, line 19, change "meltol" to --maltol--.

Column 3, line 20, change "lecthin" to --lecithin--.

Column 3, line 68, change "sUction" to --suction--.

Column 4, line 2, change "sUch" to --such--.

Column 4, line 14, change "sUch" to --such--.

Column 4, line 24, change "sUction" to --suction--.

Column 4, line 32, change "measUred" to --measured--.

Column 4, line 37, change "same smoke" to --main smoke--.

Column 5, line 7, change "colUmn" to --column--.

Column 5, line 8, change "he" to --the--.

Column 5, line 14, change "moUth" to --mouth--.

Column 5, line 23, change "5a" to --5b--.

Column 5, line 56, change "Water" to --water--.

Column 6, line 7, change "noxioUs" to --noxious--.

Column 6, line 26, change "N-nitor-" to -- N-nitro- --.

UNITED STATES PATENT AND TRADEMARK OFFICE

CERTIFICATE OF CORRECTION

PATENT NO. : 5,000,198

DATED : March 19, 1991

INVENTOR(S) : Mituo Nakajima

It is certified that error appears in the above-identified patent and that said Letters Patent is hereby corrected as shown below:

Column 6, line 41, after "can" insert --provide--.

Signed and Sealed this

Fifteenth Day of June, 1993

*Attest:*

Michael K. Kirk

MICHAEL K. KIRK

*Attesting Officer*

*Acting Commissioner of Patents and Trademarks*